US008528901B2

(12) United States Patent
Yamada

(10) Patent No.: US 8,528,901 B2
(45) Date of Patent: Sep. 10, 2013

(54) PAPER FEED MECHANISM AND PRINTER

(75) Inventor: Masahiko Yamada, Omi-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/716,224

(22) Filed: Mar. 2, 2010

(65) Prior Publication Data

US 2010/0219581 A1 Sep. 2, 2010

(30) Foreign Application Priority Data

Mar. 2, 2009 (JP) ..... 2009-047672

(51) Int. Cl.
*B65H 5/06* (2006.01)

(52) U.S. Cl.
USPC ..... 271/274; 271/273

(58) Field of Classification Search
USPC ..... 271/272–274
See application file for complete search history.

(56) References Cited

U.S. PATENT DOCUMENTS

| | | | | |
|---|---|---|---|---|
| 4,605,218 | A * | 8/1986 | Knepper et al. | 271/238 |
| 5,169,250 | A | 12/1992 | Tsuru et al. | |
| 5,988,635 | A * | 11/1999 | Ohshima | 271/274 |
| 6,059,280 | A * | 5/2000 | Yamauchi et al. | 271/109 |
| 7,775,516 | B2 * | 8/2010 | Miwa | 271/145 |
| 2006/0255528 | A1 * | 11/2006 | Okada et al. | 271/121 |
| 2007/0018387 | A1 * | 1/2007 | Yamamoto | 271/272 |
| 2007/0091140 | A1 * | 4/2007 | Taga | 347/30 |
| 2008/0111298 | A1 * | 5/2008 | Abe | 271/272 |
| 2009/0212495 | A1 * | 8/2009 | Okuno | 271/272 |
| 2009/0309299 | A1 * | 12/2009 | Ledgerwood et al. | 271/274 |

FOREIGN PATENT DOCUMENTS

| | | | |
|---|---|---|---|
| JP | 05-092627 | A | 4/1993 |
| JP | 07-323623 | A | 12/1995 |
| JP | 10-007284 | A | 1/1998 |
| JP | 10007284 | * | 1/1998 |
| JP | 11-199087 | A | 7/1999 |
| JP | 2004-269176 | A | 9/2004 |

* cited by examiner

*Primary Examiner* — Patrick Cicchino
(74) *Attorney, Agent, or Firm* — Kilpatrick Townsend & Stockton LLP

(57) ABSTRACT

A printer has a paper feed mechanism that can reliably balance the paper feed force of the paper feed roller and paper pressure roller on the left and right sides of the recording paper width. Using the self-centering action of a pressure lever fulcrum and adjustment of the position where an extension spring applies force, the paper feed mechanism of a printer can press the paper pressure roller that is supported by a pressure lever to a paper feed roller so that the paper pressure roller applies equal pressure at all points along the width of the paper feed roller, can balance the paper feed force applied by the paper feed roller and the paper pressure roller to the recording paper left and right widthwise to the paper, and can prevent the recording paper from meandering, skewing, and jamming.

8 Claims, 8 Drawing Sheets

PAPER FEED MECHANISM AND PRINTER

This application claims priority to Japanese Patent Application No. 2009-047672, filed Mar. 2, 2009, the entirety of which is incorporated by reference herein.

BACKGROUND

1. Technical Field

The present invention relates to a paper feed mechanism that conveys recording paper by means of a paper feed roller and paper pressure roller, and to a printer.

2. Related Art

A paper feed mechanism that conveys recording paper while pressing the recording paper by means of a paper pressure roller to a paper feed roller that is driven rotationally by a motor are commonly used in roll paper printers and other types of printers. Paper feed mechanisms of this type are taught in Japanese Unexamined Patent Appl. Pub. JP-A-H05-92627 and Japanese Unexamined Patent Appl. Pub. JP-A-H07-323623.

Japanese Unexamined Patent Appl. Pub. JP-A-2004-269176 teaches a paper feed mechanism that uses a torsion bar to press the paper pressure roller to the paper feed roller.

Self-centering mechanisms are commonly used with paper feed mechanisms in order to balance the contact pressure of the paper pressure roller to the paper feed roller in the widthwise direction, which is the same as the axial direction of the rollers. The self-centering mechanism causes the paper pressure roller to rock on its width wise center, and causes the paper pressure roller to press against the paper feed roller with uniform pressure in the axial direction.

However, when the center of the paper feed roller found by this self-centering mechanism is offset from the widthwise center of the paper transportation path, one side of the width of the conveyed recording paper will be held between the rollers with greater pressure than is applied to the other side. When this happens, the paper feed force applied to the right and left sides of the recording paper will not be the same despite the self-centering operation of the self-centering mechanism, and the recording paper will therefore become skewed and proceed at a bias to the paper feed direction, and possibly lead to a paper jam.

Roll paper printers that have the paper feed roller disposed to an access cover that opens and closes a roll paper compartment, have the paper pressure roller disposed to a fixed position on the paper frame side, and are configured so that opening the access cover also opens the paper transportation path are also known from the literature. In roll paper printers of this type, however, the paper feed roller and the paper pressure roller are disposed to separate parts, and the widthwise centers of these rollers are easily offset from each other. As a result, the recording paper can easily become skewed despite there being a self-centering mechanism being used to prevent skewing.

SUMMARY

The present invention provides a paper feed mechanism for a printer that has a self-centering mechanism that is capable of reliably balancing the paper feed force of the paper feed roller and paper pressure roller on the left and right sides of the recording paper width, and to a printer having this paper feed mechanism.

A first aspect of the invention is a paper feed mechanism for a printer, the paper feed mechanism having a paper feed roller; a paper pressure roller that is pressed to the paper feed roller; a roller support member that supports the paper pressure roller; a rocking support member that supports the roller support member pivotably on a rocker fulcrum; and an urging member that urges the paper pressure roller to the paper feed roller by means of the intervening roller support member. The paper pressure roller extends widthwise to the paper at the downstream side of the roller support member in the paper feed direction, the urging position of the urging member is on the upstream side of the roller support member in the paper feed direction, and the urging position is movable widthwise to the paper.

With the paper feed mechanism according to this aspect of the invention the roller support member that is supported so that it can rock front-back and left-right by a rocking support member is urged so that it rocks front and back by an urging member at a position on the upstream side (back side) in the paper feed direction. As a result, a paper pressure roller attached at the downstream side thereof in the paper feed direction is pressed against the paper feed roller side. Furthermore, because the roller support member can rock widthwise to the paper (left and right) by means of the rocking support member, the paper pressure roller is automatically centered by the roller support member rocking left and right so that the paper pressure roller applies pressure uniformly to the paper feed roller at all parts thereof across the paper width (left and right).

When the fulcrum of the self-centering action is not aligned with the center of the paper feed roller width (the center of the width of the recording paper transportation path), the paper feed force applied to the conveyed recording paper is not balanced left to right across the paper width, and the recording paper tends to meander and become skewed. The invention, however, enables moving the position where the urging member urges the roller support member widthwise to the paper (left and right), and when this urging position is moved, the urging force working at the left and right sides of the paper pressure roller can be increased and decreased. As a result, a side to side imbalance in the paper feed force of the paper feed roller and the paper pressure roller can be eliminated, and the recording paper can be conveyed without skewing, meandering, or jamming.

In a paper feed mechanism according to another aspect of the invention the rocking support member includes a shaft member extending widthwise to the paper. In this aspect of the invention the roller support member has a guide hole formed in parts thereof on both sides of the paper width to support both end parts of the shaft member so that the shaft member can move a specified amount, and has the rocker fulcrum rendered in a part thereof substantially in the center of the paper width. The shaft member of the rocking support member passes through the guide holes and engages the rocker fulcrum.

The urging member can be an extension spring or other type of spring. In this aspect of the invention a spring catch surface for catching and holding the spring member is rendered on the roller support member, and a plurality of concave parts or convex parts for catching the spring are formed to the spring catch surface along the paper width.

The paper pressure roller of a paper feed mechanism according to another aspect of the invention includes a paper pressure roller shaft and a plurality of roller bodies disposed coaxially to the paper pressure roller shaft, and the plural roller bodies are disposed to the paper pressure roller shaft at left and right positions substantially symmetrical in the axial direction.

When the width of the paper pressure roller is wide, widthwise deviation in the roller diameter increases, and maintaining uniform contact pressure to the paper feed rollers across the paper width is difficult. However, by rendering the paper pressure roller using a plurality of roller bodies, the width of each roller body in the paper pressure roller can be reduced, widthwise deviation in the roller diameter can therefore be suppressed, and the recording paper can be conveyed with uniform pressure across the width of the recording paper. Meandering, skewing, and jamming of the recording paper can therefore be prevented.

Further preferably, the paper pressure roller is composed of two roller bodies, each roller body has an outside circumference surface of substantially the same width, and the gap between the roller bodies is substantially equal to the width of the outside surface of each roller.

If the width of the roller bodies rendering the paper pressure roller is sufficiently narrow, and the roller bodies are disposed symmetrically left and right to the center of the width, the paper feed force works at the center of the width of the recording paper that is conveyed while pressed by the paper pressure roller to the paper feed roller. An imbalance in the paper feed force across the width of the recording paper can therefore be suppressed compared with a configuration in which the paper feed force is applied to positions separated to both sides of the paper width, and the recording paper can be conveyed without skewing or meandering.

A paper feed mechanism according to another aspect of the invention also has a stopping member that limits rocking of the roller support member. The paper feed roller can retract relative to the paper pressure roller from a pressure position at which the paper pressure roller is pressed thereto; the roller support member has at both sides thereof in the paper width direction a contact part that can contact the stopping member; and when the paper feed roller retracts relatively from the pressure position, the contact parts contact the stopping member.

When the paper feed roller and the paper pressure roller move away from the position where they are pressed together, a stopping member that limits rocking front and back is needed because there is otherwise nothing limiting the roller support member that supports the paper pressure roller from rocking in the paper feed direction (front and back). If only one left or right side of the roller support member is limited from rocking in this case, the roller support member will rock left and right on the rocker fulcrum, and the paper pressure roller will be tilted to one side. When the paper pressure roller is then pressed against the paper feed roller again, the paper pressure roller will contact the paper feed roller on one side. As a result, the locking mechanism, for example, that holds the paper feed roller and the paper pressure roller pressed together may engage on only one side, that is, may engage normally on one side widthwise to the paper and not engage completely on the other side.

However, because both left and right sides of the roller support member contact the stopping member with the paper feed mechanism according to the invention, the paper pressure roller separated from the paper feed roller will not be tilted at an angle and will be held parallel to the paper feed roller. Therefore, when the paper feed roller and the paper pressure roller are pressed together again, the locking mechanism, for example, can be prevented from engaging on only one side.

A printer according to another aspect of the invention has the paper feed mechanism described above. Because the recording paper can thus be conveyed by the paper feed mechanism passed the printing position without skewing or meandering, a drop in print quality, paper jams, and other problems caused by recording paper transportation problems can be prevented.

The paper feed mechanism of the invention can also be used as a paper feed mechanism in a roll paper printer of which the recording paper transportation path is opened by opening an access cover. More specifically, a printer according to this aspect of the invention has a roll paper compartment formed inside the printer case; an access cover that is attached to the printer case for opening and closing the roll paper compartment; and the paper feed mechanism described above. The paper feed roller of the paper feed mechanism is attached to the access cover; the paper pressure roller, the roller support member, the rocking support member, the urging member, and the stopping member of the paper feed mechanism are disposed on the printer case side; the paper pressure roller is pressed to the paper feed roller when the access cover is closed; and when the access cover opens, the paper feed roller separates from the paper pressure roller, and the contact parts of the roller support member contact the stopping member. Rocking of the roller support member is limited by the contact parts contacting the stopping member.

Effect of the Invention

The paper pressure roller of the paper feed mechanism according to the invention is supported by a roller support member that can rock front-back and left-right centered on a rocking fulcrum by means of a rocking support member. The urging position of the urging member on the roller support member can be shifted to the left and right sides. By adjusting the self-centering action centered on the rocking fulcrum and the urging position of the urging member, the paper feed force applied by the paper feed roller and paper pressure roller to the recording paper can be balanced left and right widthwise to the paper, and the recording paper can therefore be prevented from meandering, skewing, and jamming.

When the paper pressure roller is rendered by a plurality of roller bodies so that the width of each roller body is narrower, widthwise deviation in the roller diameter of each roller body can be suppressed, uniform paper feed pressure can be applied across the paper width, and the recording paper can therefore be prevented from meandering, skewing, and jamming.

Furthermore, because the paper pressure lever can be prevented from tilting at an angle when the paper pressure roller is separated from the paper feed roller and the left and right side parts of the roller support member are in contact with the stopping member, when the paper pressure roller is again pressed against the paper feed roller, the locking mechanism that holds the pressure between the paper pressure roller and the paper feed roller can be prevented from being engaged on only one side.

Other objects and attainments together with a fuller understanding of the invention will become apparent and appreciated by referring to the following description and claims taken in conjunction with the accompanying drawings.

DESCRIPTION OF EXEMPLARY EMBODIMENTS

A roll paper printer having a paper feed mechanism according to a preferred embodiment of the invention is described below with reference to the accompanying figures.

General Configuration

Figure 1:
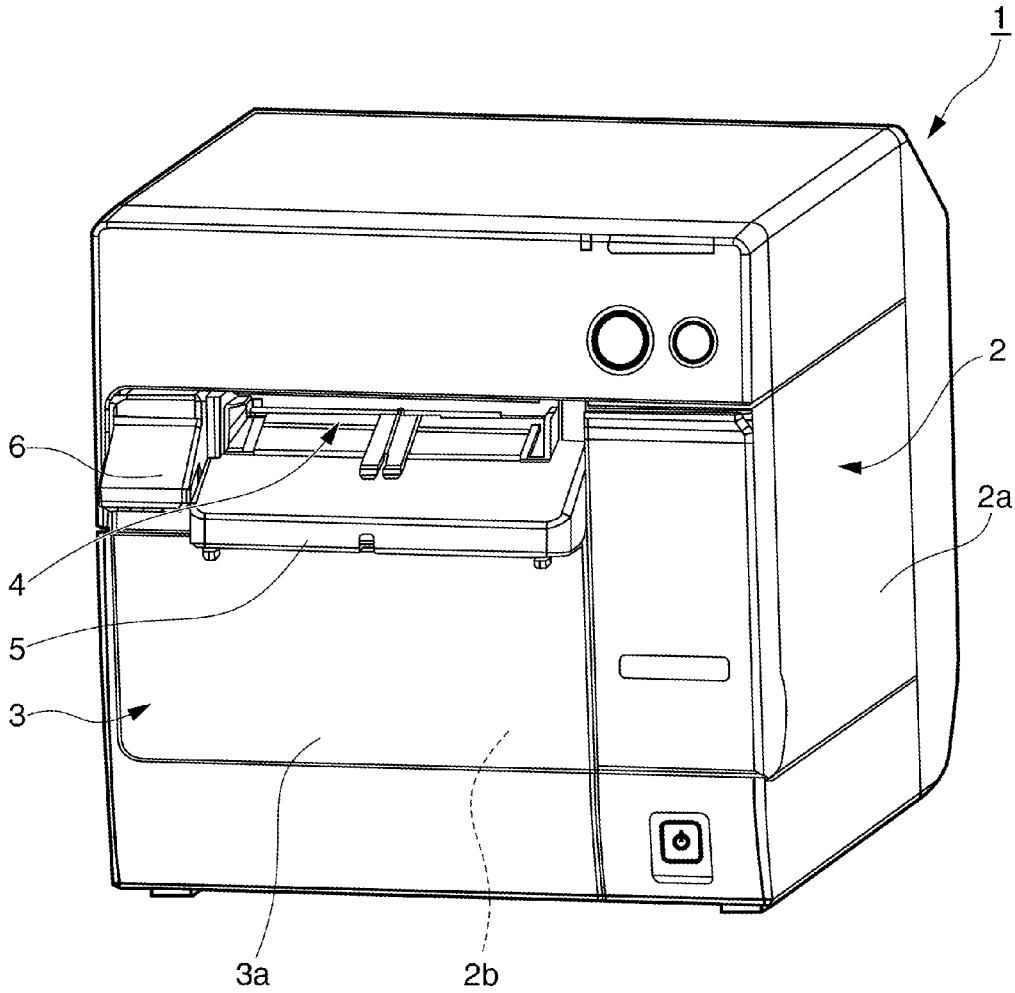
FIG. 1 is an external oblique view of a roll paper printer according to a preferred embodiment of the invention.
Figure 2:
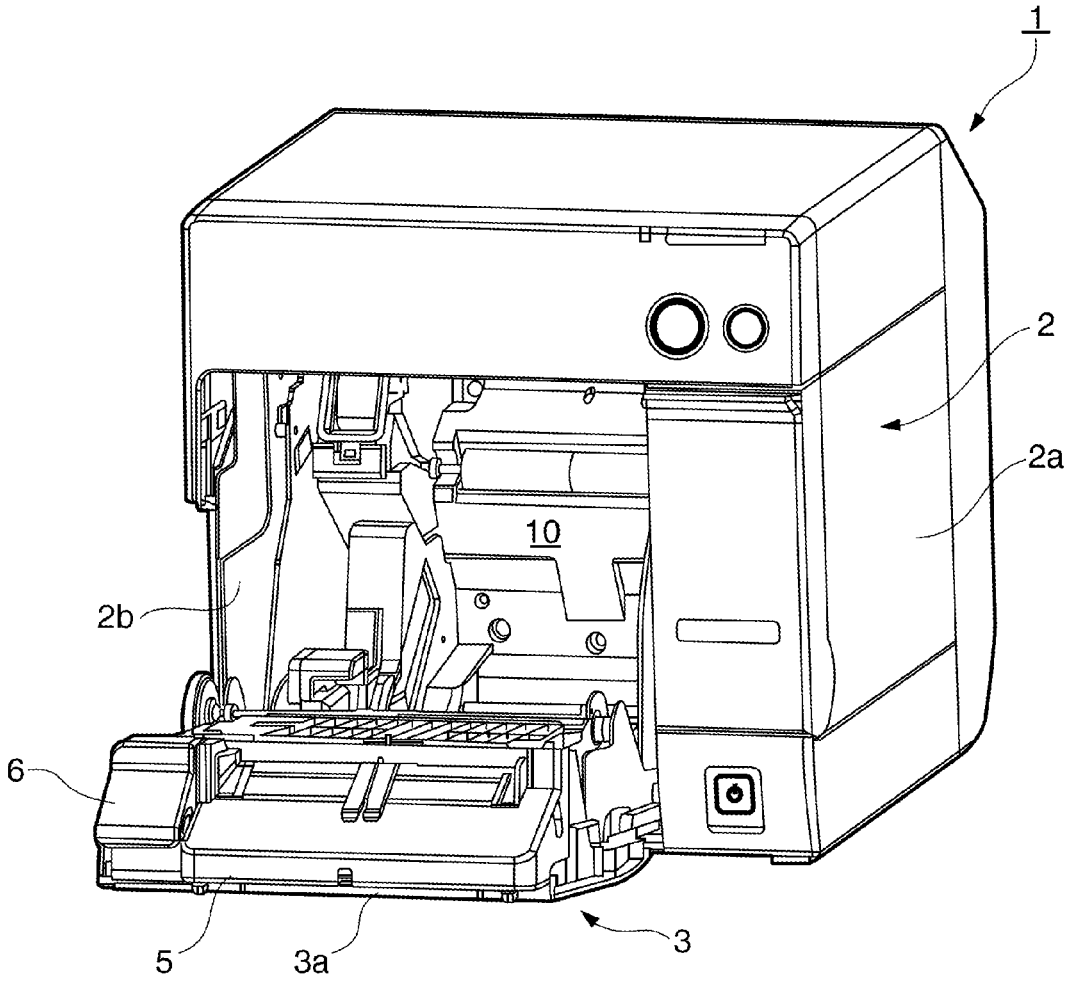
FIG. 2 is an external oblique view of the roll paper printer with the access cover open.

FIG. 1 is an oblique view showing an inkjet roll paper printer according to a preferred embodiment of the invention. FIG. 2 is an oblique view of the printer with the cover completely open.

The roll paper printer 1 has a rectangular box-like body 2 and an access cover 3 that opens and closes and is disposed to the front of the body 2. A recording paper exit 4 of a specific width is formed at the front of the outside case 2*a* of the printer body 2. An exit guide 5 projects to the front from the bottom of the paper exit 4, and a cover opening lever 6 is disposed beside the exit guide 5. A rectangular opening 2*b* for loading and removing roll paper is formed in the outside case 2*a* below the exit guide 5 and cover opening lever 6, and this opening 2*b* is closed by the cover case 3*a* of the cover 3.

Operating the cover opening lever 6 unlocks the cover 3. When the exit guide 5 is pulled forward after unlocking the cover, the cover 3 pivots at the bottom end part thereof and opens forward to a substantially horizontal position. When the cover 3 opens as shown in FIG. 2, the roll paper compartment 10 inside the printer is also opened. The recording paper transportation path from the roll paper compartment 10 to the paper exit 4 is also opened at the same time, and the roll paper can be easily replaced from the front of the printer.

Figure 3:
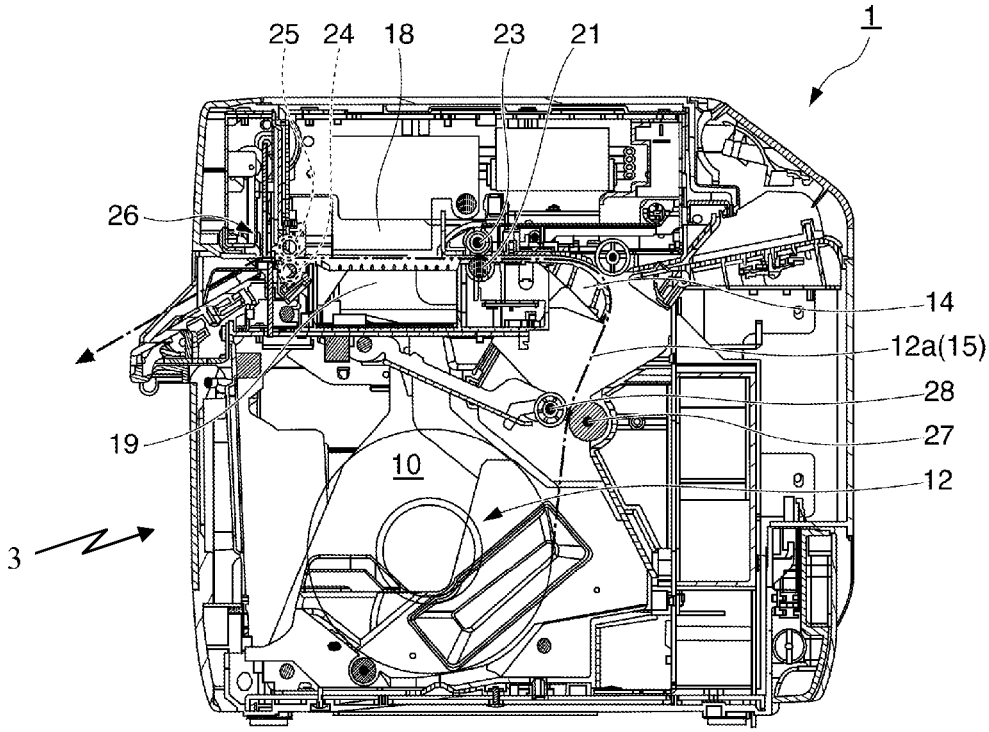
FIG. 3 is a vertical section view showing the internal structure of the roll paper printer.
Figure 4:
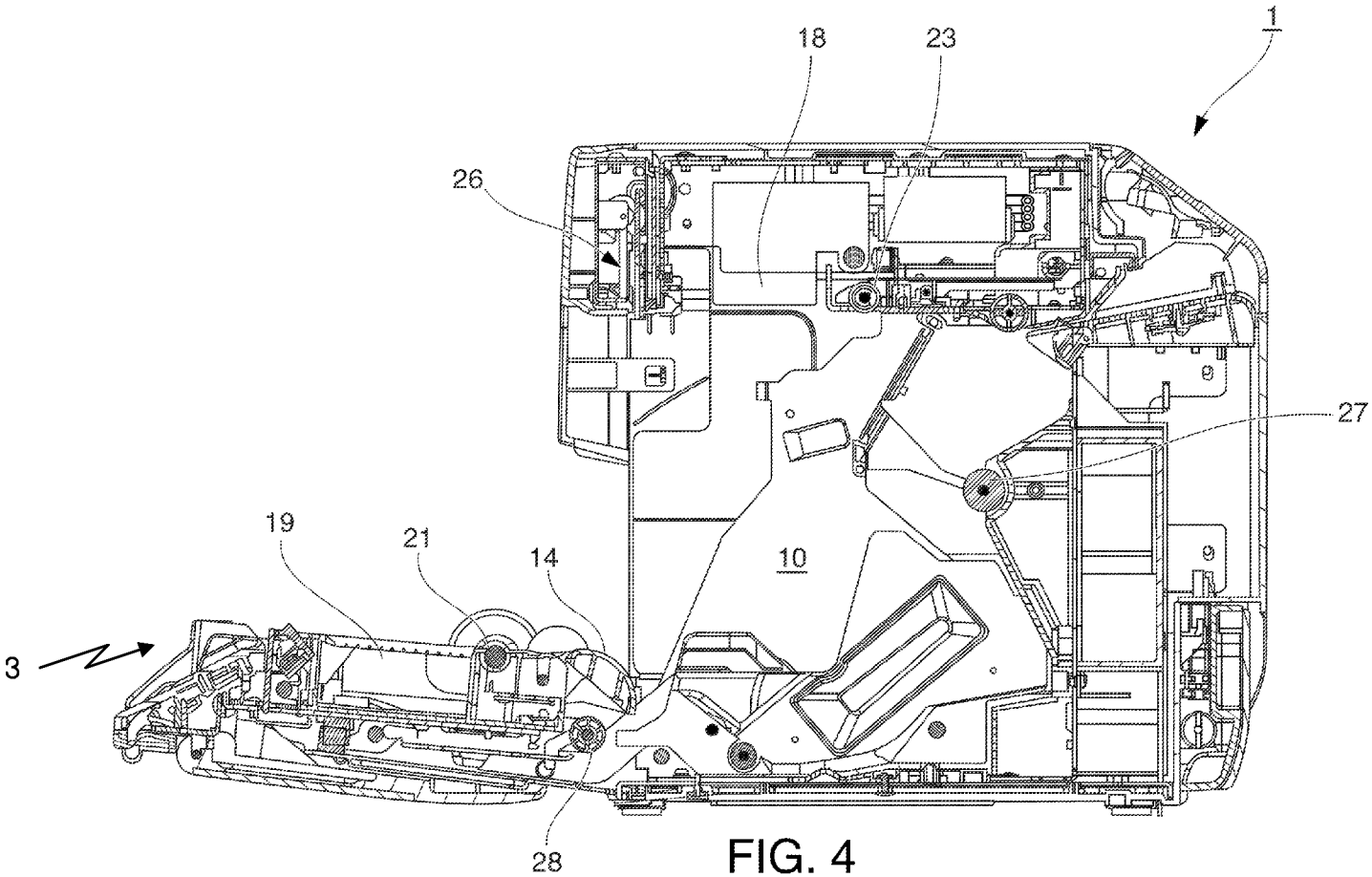
FIG. 4 is a vertical section view of the roll paper printer when the access cover is open.

FIG. 3 is a vertical section view showing the internal configuration of the roll paper printer 1. FIG. 4 is a vertical section view when the cover 3 is completely open.

A roll paper compartment 10 is formed in the center between the side walls of the printer case 2 inside the roll paper printer 1. Roll paper 12 is loaded inside the roll paper compartment 10 widthwise to the printer so that the roll paper 12 can roll on its side. The roll paper 12 has a continuous length of recording paper 12*a* (indicated by the bold dot-dash line in the figure) wound into a roll.

The continuous recording paper 12*a* delivered from the roll paper 12 stored in the roll paper compartment 10 is pulled diagonally upward, then curves around the curved tension guide 14, and is conveyed through the horizontal transportation path 15 (the same path as the dot-dash line denoting the recording paper 12*a*), and is then discharged from the paper exit 4.

The part of the transportation path 15 that extends horizontally is directly above the roll paper compartment 10, an inkjet head 18 and platen 19 are disposed with a specific gap there between to this part of the transportation path, and the platen 19 determines the printing position of the inkjet head 18.

The paper feed roller 21 is located on the upstream side of the inkjet head 18 on the transportation path 15, and the paper feed roller 21 is driven rotationally by a paper feed motor not shown. The paper pressure roller 23 is pressed against the paper feed roller 21 with the recording paper 12*a* there between so that the paper pressure roller 23 rotates in conjunction with the paper feed roller 21. A downstream-side paper feed roller 24 that rotates in synchronization with the paper feed roller 21 is disposed on the downstream side of the inkjet head 18, and a paper pressure roller 25 is pressed to the downstream-side paper feed roller 24 so that it rotates in conjunction therewith the recording paper 12*a* there between.

An automatic cutter 26 is disposed near the paper exit 4 to cut the leading end part of the recording paper 12*a* widthwise to a specific length after printing is completed.

The tension guide 14 is disposed to a printer frame not shown so that the tension guide 14 can move within a specific range, and is constantly urged in the direction applying tension to the recording paper 12*a* by a spring member not shown. As a result, constant tension is held on the recording paper 12*a* pulled through the transportation path 15. A guide sensor not shown is disposed near the tension guide 14, and when slack develops in the recording paper 12*a* and the tension guide 14 is moved in the urging direction by the urging member, this movement of the tension guide 14 is detected by the guide sensor, and the tension on the recording paper 12*a* can be controlled based on the sensor output.

A delivery roller 27 and a pressure roller 28 pressed thereto are disposed in the roll paper compartment 10 in this embodiment of the invention, and the recording paper 12*a* delivered from the roll paper 12 passes between and is delivered by the delivery roller 27 and pressure roller 28 to the tension guide 14. The delivery roller 27 is driven by a motor not shown, and is controlled so that slack does not develop in the recording paper 12*a* supplied by the delivery roller 27.

Paper Feed Mechanism

Figure 5:
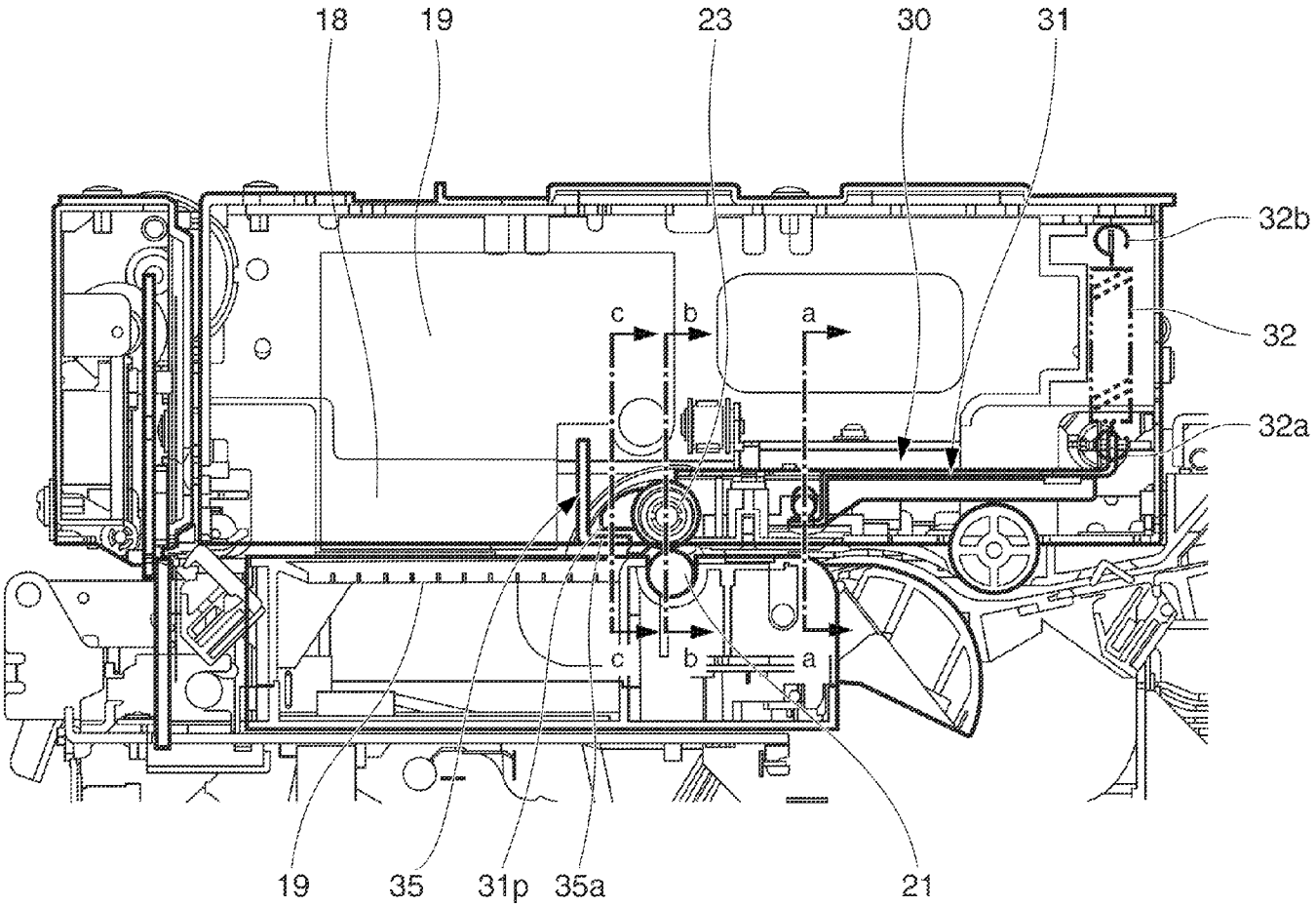
FIG. 5 is a partial section view showing the paper feed mechanism.
Figure 6:
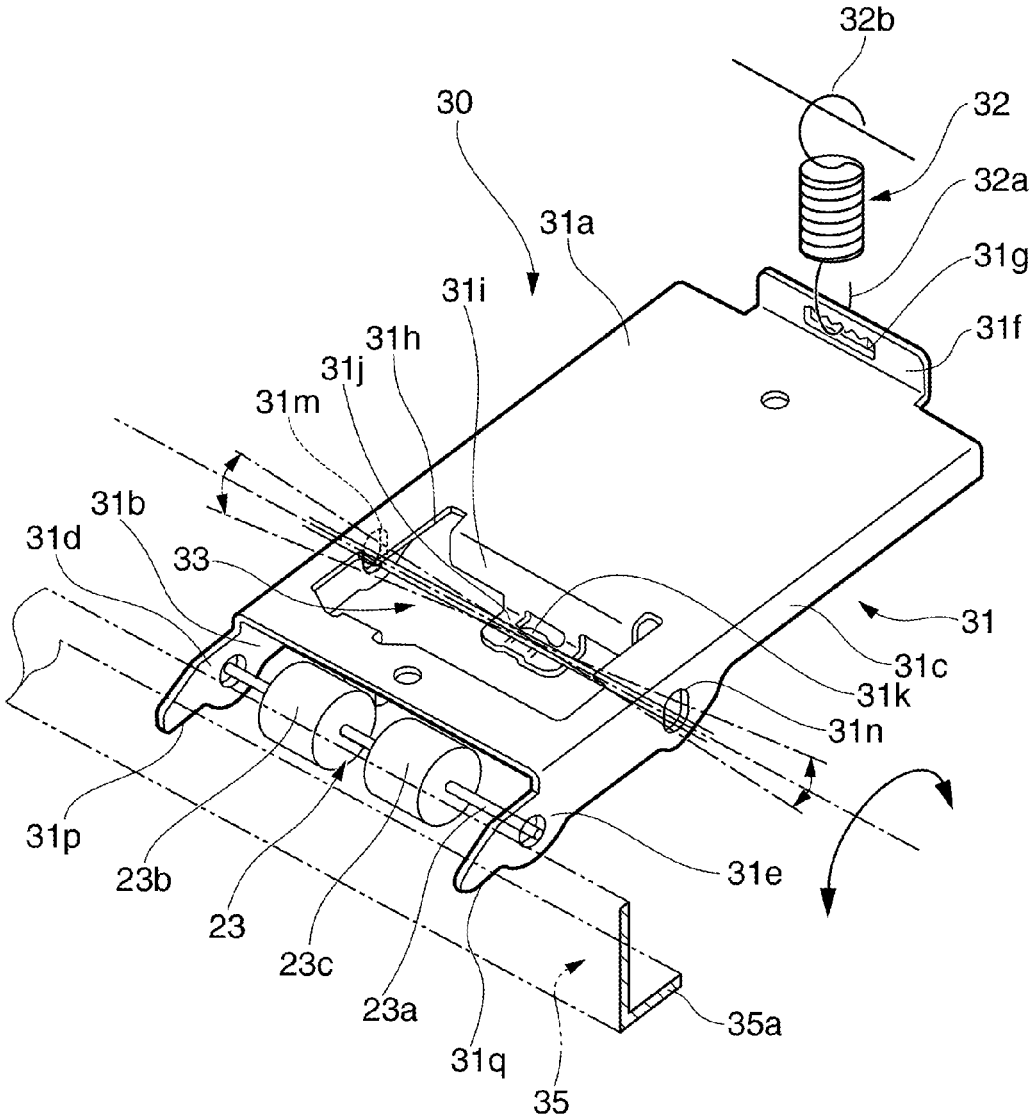
FIG. 6 describes the paper feed mechanism shown in FIG. 5.
Figure 7A:
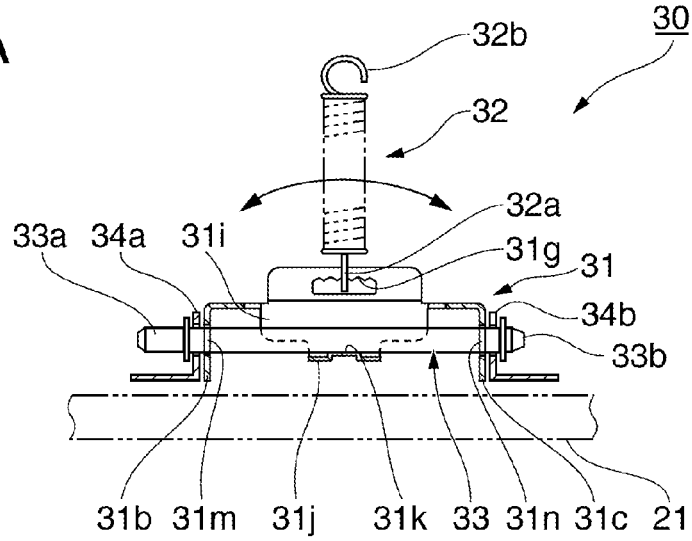
FIG. 7 is a partial section view of the paper feed mechanism shown in FIG. 5.
Figure 7B:
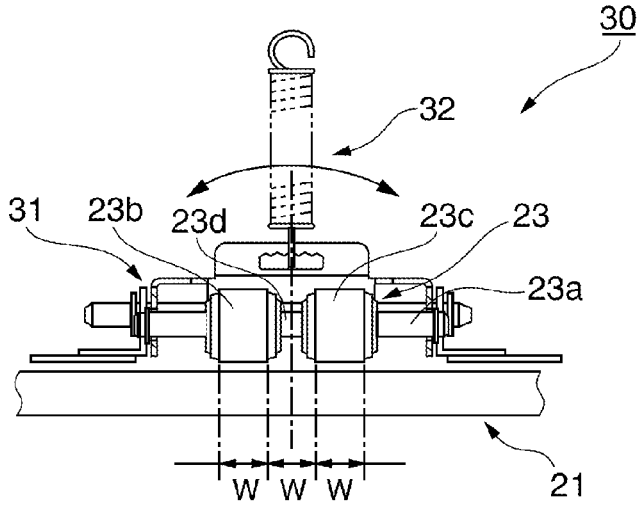
Figure 7C:
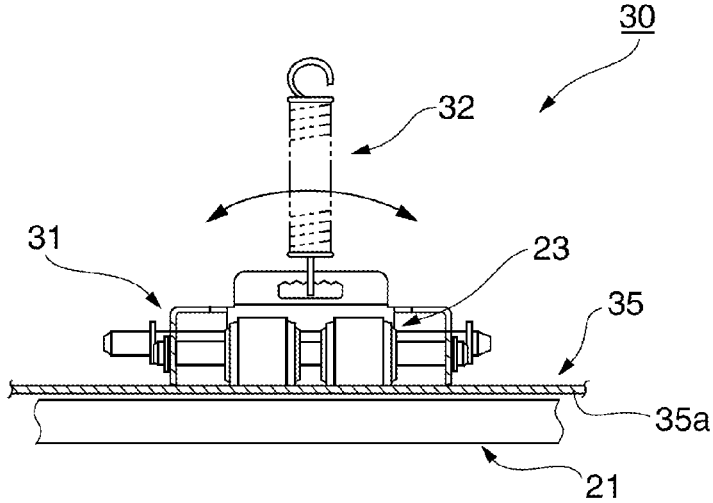

FIG. 5 is a partial schematic section view showing the part rendering the paper feed mechanism in the printer 1, and FIG. 6 is a descriptive diagram of the same. FIG. 7A, FIG. 7B, and FIG. 7C are partial section views through line a-a, line b-b, and line c-c, respectively, in FIG. 5.

As shown in these figures, the paper feed mechanism 30 includes the paper feed roller 21 and paper pressure roller 23 described above. Note that the paper feed roller 21 is not shown in FIG. 6. The paper feed mechanism 30 also has a flat, rectangular pressure lever 31 (roller support member) made of sheet metal. The paper feed mechanism 30 includes top panel portion 31*a* that extends horizontally between the front and back of the printer, and left and right side wall parts 31*b* and 31*c* that are bent down perpendicularly from the opposite sides of the top panel portion 31*a*.

Support arms 31*d* and 31*e* that project to the front are formed at the front ends of the two side wall parts 31*b* and 31*c* at the front end of the pressure lever 31 (that is, the end on the downstream side in the paper transportation direction), and the paper pressure roller 23 is disposed horizontally widthwise to the printer between these support arms 31*d* and 31*e*. A spring catch unit 31*f* of a specific width is formed at the back end of the pressure lever 31 bending perpendicularly upward from the widthwise center of the back end of the top panel portion 31*a*, a horizontally long aperture that extends widthwise is formed in the spring catch 31*f*, and a spring catch face 31*g* is rendered on the top inside face of this horizontal aperture.

The bottom end hook 32*a* of an extension spring 32 (urging member) that extends vertically is hooked on the spring catch face 31*g*. The top end hook 32*b* of the extension spring 32 is attached to the printer frame of the printer case 2. As will be known from FIG. 7A, the 32*g* has a plurality of serrated grooves formed at a regular interval along its length (that is, along the width of the paper). The bottom end hook 32*a* of the extension spring 32 is hooked on one of these grooves.

A rectangular window 31*h* is cut into the top panel portion 31*a* at a position slightly to the front of the longitudinal center (the center between the front and back ends) of the pressure lever 31. A vertical bent shoulder 31*i* of a specific width that bends down perpendicularly to the top panel portion 31*a* is formed at the back edge part of the window 31*h*, and a horizontal bent flange 31*j* that is bent perpendicularly forward is formed at the bottom end of the vertical bent shoulder 31*i*. The horizontal bent flange 31*j* is positioned in the middle of the width (that is, between the left and right sides) of the pressure lever 31 (at a position corresponding to the widthwise center of the paper pressure roller 23). As shown in FIG. 6 and FIG. 7A, a pressure lever fulcrum 31*k* (rocker fulcrum) that protrudes upward from both sides is formed in the middle of the width of the horizontal bent flange 31*j*.

The pressure lever support shaft 33 (rocking support member) is positioned horizontally widthwise to the printer when resting on this pressure lever fulcrum 31*k*. As shown in FIG. 6 and FIG. 7A, the end parts 33*a* and 33*b* at opposite ends of the pressure lever support shaft 33 protrude to the opposite sides through vertically long oval guide holes 31*m* and 31*n* formed in the side wall parts 31*b* and 31*c* on opposite sides of the pressure lever 31. The vertical length of the guide holes 31*m* and 31*n* is greater than the diameter of the pressure lever support shaft 33. Vertical support brackets 34*a* and 34*b* that are attached to the printer frame on the printer case 2 side are disposed beside the side wall parts 31*b* and 31*c* of the pressure lever 31, and the pressure lever support shaft 33 is secured horizontally widthwise to the printer by these vertical support brackets 34*a* and 34*b*.

The pressure lever 31 is thus supported by the pressure lever support shaft 33 so that the pressure lever 31 can rock front and back and left and right centered on the pressure lever fulcrum 31*k*.

The pressure lever 31 that is urged by the extension spring 32 can thus rock left and right (sideways) within the range allowed by the guide holes 31*m* and 31*n* by means of the self-centering action centered on the pressure lever fulcrum 31*k*. As a result, the paper pressure roller 23 disposed at the front end of the pressure lever 31 an also rock left and right. The paper pressure roller 23 is thereby pressed against the paper feed roller 21 with uniform pressure applied at all points in the left and right (widthwise) direction.

As shown in FIG. 7B, the paper pressure roller 23 has a roller shaft 23*a* and two roller units 23*b* and 23*c* disposed coaxially and freely rotatably to the roller shaft 23*a*. These roller units 23*b* and 23*c* have the same width, and are disposed symmetrically left and right to the center 23*d* to the center of the length of the roller shaft 23*a*. The distance between the roller units 23*b* and 23*c* is approximately equal to the width W of each roller unit.

Figure 8:
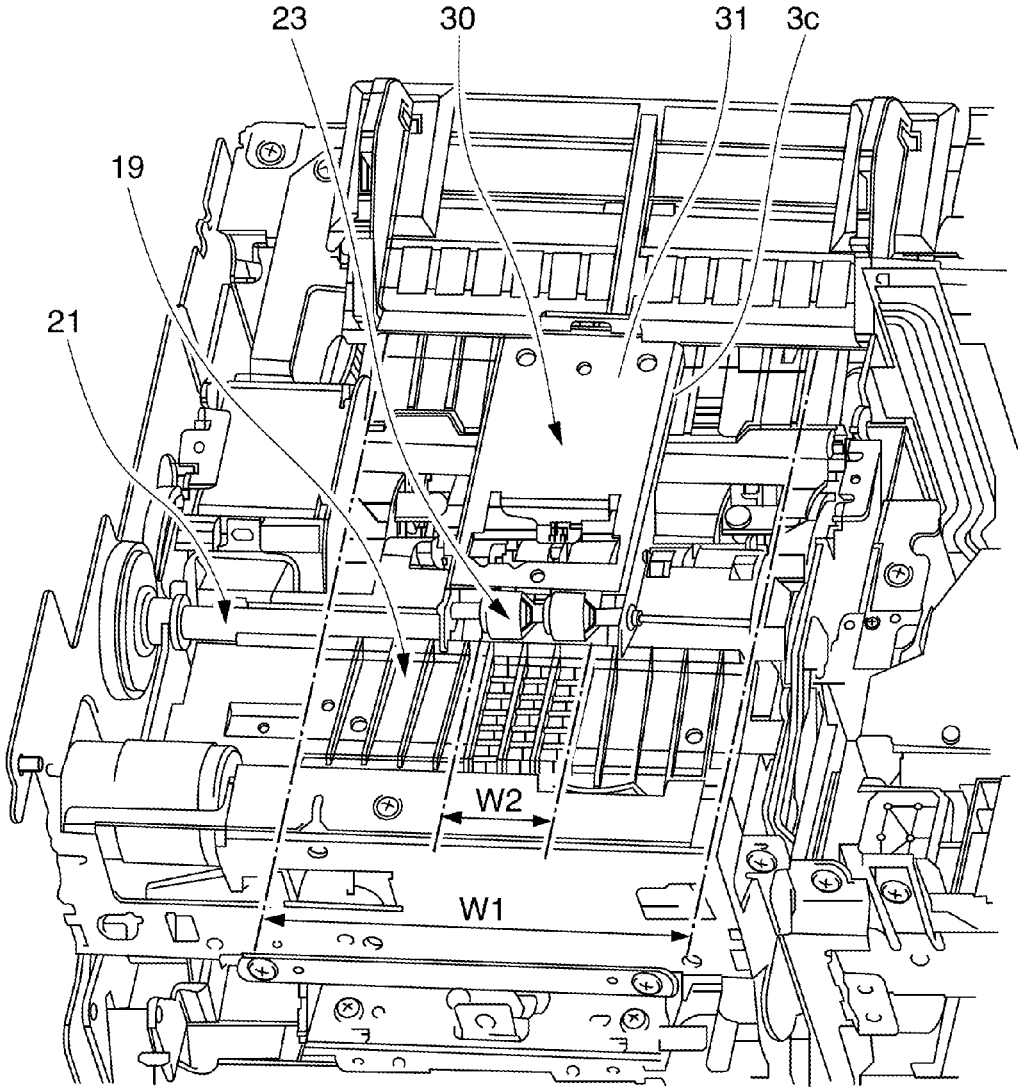
FIG. 8 is an oblique view showing the paper feed mechanism in FIG. 5 and the recording paper transportation path over the platen.

FIG. 8 describes a part of the internal configuration of the printer 1, and shows the platen and the paper feed mechanism 30. In FIG. 8 width W1 denotes the width of the paper transportation path over the platen (the width of the widest conveyable recording medium). The length of the paper feed roller 21 in this embodiment of the invention covers this width W1, but the paper pressure roller 23 is disposed to a narrower width W2 in the center of width W1, and the width of each of the roller units 23*b* and 23*c* is even narrower, that is approximately ⅓ of width W2.

Referring again to FIG. 4 to FIG. 7, the paper feed roller 21 of the paper feed mechanism 30 is disposed on the cover 3 as described above. Therefore, when the cover 3 opens, the paper feed roller 21 and platen 19 separate from the paper pressure roller 23 and the nozzle surface of the inkjet head 18, respectively, and the transportation path 15 becomes open. In this position, the urging force of the extension spring 32 causes the pressure lever 31 supporting the paper pressure roller 23 to rock on the pressure lever support shaft 33 so that its front end tilts down and the paper pressure roller 23 moves down.

As shown in FIG. 5 and FIG. 6, an L-shaped stopping plate 35 that extends widthwise is disposed below and in front of the pressure lever 31. The stopping plate 35 is attached to the printer frame side of the printer case 2, and extends horizontally widthwise to the printer. The bottom end faces 31*p* and 31*q* of the left and right support arms 31*d* and 31*e* at the front end of the pressure lever 31 are rendered so that they can contact the top of the horizontal ledge part 35*a* of the stopping plate 35. Therefore, when the cover 3 is opened, the pressure lever 31 is held horizontal by the stopping plate 35, and the paper pressure roller 23 supported by the pressure lever 31 is also held horizontal.

Operational Effect of the Paper Feed Mechanism

The operational effect of the foregoing paper feed mechanism 30 is described next.

With the paper feed mechanism 30 thus described, the paper pressure roller 23 supported at the front end of the pressure lever 31 is pressed against the paper feed roller 21 with uniform contact pressure along the roller width by the self-centering action centered on the pressure lever fulcrum 31*k*.

In addition, when the pressure lever fulcrum 31*k* that is the rocking center of this self-centering action is not at the widthwise center of the paper feed roller 21, the paper feed force that acts on the conveyed recording paper is unbalanced left and right, and the recording paper 12*a* meanders easily and becomes skewed. When this occurs, the paper feed force applied to the recording paper 12*a* can be rebalanced widthwise to the paper by shifting the position where the bottom end hook 32*a* of the extension spring 32 is attached in the widthwise direction.

For example, as shown in FIG. 6 and FIG. 7, if the position where the spring is caught is in the widthwise center and is then shifted to the right side, the force of the spring is shifted to the left side of the paper pressure roller 23 supported by the pressure lever 31 in front of the pressure lever fulcrum 31*k*. If the position where the spring is caught is moved in the opposite direction, the force of the spring is increased on the right side of the paper feed roller 21. Therefore, by adjusting where the spring is attached sideways, the paper feed force of the paper feed roller 21 and the paper pressure roller 23 can be balanced left and right to the paper width. The recording paper 12*a* can therefore be conveyed without skewing or meandering.

In the paper feed mechanism 30 according to this embodiment of the invention the paper pressure roller 23 is rendered by two narrow roller units 23*b* and 23*c* that are disposed symmetrically left and right in a narrow range of the center of the width of the recording paper. If the width of the roller units of the paper pressure roller is great, widthwise deviations in the roller diameter also increase, and maintaining uniform contact pressure along the width of the paper feed roller can be difficult. However, by using two narrow roller bodies, this embodiment of the invention can suppress deviation in the roller diameter and apply uniform contact pressure. In addition, the paper feed force can be applied to the center of the width of the recording paper 12*a* that is conveyed while being pressed to the paper feed roller 21 by the paper pressure roller 23. The invention can therefore suppress an imbalance in the paper feed force on left and right sides of the recording paper better than a configuration that applies the paper feed force to positions with greater distance there between along the paper width, and can convey the recording paper without skewing or meandering.

Furthermore, because the paper feed mechanism 30 has a stopping plate 35 disposed such that both side parts of the front end of the pressure lever 31 contact the stopping plate 35 when the cover 3 opens, the pressure lever 31 is held horizontally widthwise to the printer. The paper pressure roller 23 disposed thereto is therefore also held horizontal. As a result, when the cover 3 is closed and the paper feed roller 21 and paper pressure roller 23 touch again, the contact load there between widthwise to the printer is uniform on left and right sides, and the locking mechanism of the cover 3 can be prevented from engaging on only one side.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart there from.

What is claimed is:

1. A paper feed mechanism for a printer, comprising:

a paper feed roller;

a paper pressure roller that is pressed to the paper feed roller;

a roller support member that supports the paper pressure roller;

a rocking support member that supports the roller support member pivotably on a rocker fulcrum; and an urging member that urges the paper pressure roller to the paper feed roller by the intervening roller support member;

the paper pressure roller extending widthwise to the paper at the downstream side of the roller support member in the paper feed direction, and defining an axial direction widthwise to the paper, the urging position of the urging member being on the upstream side of the roller support member in the paper feed direction, and the urging position being movable with respect to the paper pressure roller along the axial direction of the paper pressure roller;

wherein the rocking support member comprises a shaft member extending widthwise to the paper, wherein the roller support member comprises a guide hole formed in parts of the roller support member on both sides of the paper width to support both end parts of the shaft member so that the shaft member can move a specified amount, wherein the rocker fulcrum is disposed in a part of the roller support member substantially in the center of the paper width; and wherein the shaft member extends widthwise to the paper, passes through the guide holes, and engages the rocker fulcrum.

2. The paper feed mechanism for a printer described in claim 1, wherein:

the urging member is a spring member;

the roller support member has a spring catch for holding the spring member; and a plurality of concave parts or convex parts for catching the spring are formed to the spring catch along the paper width.

3. The paper feed mechanism for a printer described in claim 1, wherein:

the paper pressure roller includes a paper pressure roller shaft and a plurality of roller bodies disposed to the paper pressure roller shaft; and the plural roller bodies are disposed to the paper pressure roller shaft at left and right positions substantially symmetrical in the axial direction.

4. The paper feed mechanism for a printer described in claim 3, wherein:

there are at least two roller bodies;

each roller body has an outside circumference surface of substantially the same width; and the gap between roller bodies is substantially equal to the width of the outside surface of each roller.

5. The paper feed mechanism for a printer described in claim 1, further comprising:

a stopping member that limits rocking of the roller support member;

wherein the paper feed roller can retract relative to the paper pressure roller from a pressure position at which the paper pressure roller is pressed thereto;

the roller support member has at both sides thereof in the paper width direction a contact part that can contact the stopping member; and when the paper feed roller retracts relatively from the pressure position, the contact parts contact the stopping member.

6. A printer comprising a paper feed mechanism described in claim 1.

7. A printer comprising:

a roll paper compartment formed inside the printer case;

an access cover that is attached to the printer case for opening and closing the roll paper compartment; and the paper feed mechanism described in claim 5;

wherein the paper feed roller of the paper feed mechanism is attached to the access cover, the paper pressure roller, the roller support member, the rocking support member, the urging member, and the stopping member of the paper feed mechanism are disposed on the printer case side, the paper pressure roller is pressed to the paper feed roller when the access cover is closed, and when the access cover opens, the paper feed roller separates from the paper pressure roller, and the contact parts of the roller support member contact the stopping member.

8. The paper feed mechanism for a printer described in claim 1, wherein the roller support member is supported by the rocking support member so that the roller support member can rock front and back and left and right centered on the rocker fulcrum.

* * * * *